US006050374A

United States Patent [19]

Johnston

[11] Patent Number: 6,050,374

[45] Date of Patent: Apr. 18, 2000

[54] LUGGAGE CASE CONSTRUCTION

[76] Inventor: Tom L. Johnston, 817 Peninsula Ave., Claremont, Calif. 91711

[21] Appl. No.: 09/197,752

[22] Filed: Nov. 23, 1998

[51] Int. Cl.[7] ..... A45C 3/00

[52] U.S. Cl. ..... 190/109; 190/115; 190/125; 190/903; 16/115

[58] Field of Search ..... 190/18 A, 115, 190/125, 109, 903, 110; 16/115

[56] References Cited

U.S. PATENT DOCUMENTS

| | | | |
|---|---|---|---|
| 2,574,089 | 11/1951 | Cochran | 190/903 X |
| 3,777,862 | 12/1973 | Zipper | 190/903 X |
| 4,087,102 | 5/1978 | Spague | 190/115 X |
| 4,538,709 | 9/1985 | Williams et al. | 190/115 X |
| 5,323,887 | 6/1994 | Scicluna et al. | 190/115 X |
| 5,414,895 | 5/1995 | Kazmark, Jr. | 190/115 |
| 5,474,162 | 12/1995 | Shyr et al. | 190/115 X |
| 5,476,163 | 12/1995 | Wu | 190/115 |
| 5,810,166 | 9/1998 | Weinreb | 190/903 X |

*Primary Examiner*—Stephen P. Garbe
*Assistant Examiner*—Tri M. Mai
*Attorney, Agent, or Firm*—George J. Netter

[57] ABSTRACT

A luggage case (10) with a retractable handle (17) includes handle retraction apparatus (24) located within the luggage case adjacent a bottom wall (20) and covered over by a fabric panel (34). Inner mounting parts for luggage case wheels (14) are also located under the fabric panel (34). The panel (34) includes a central flap (58) releasably secured to the panel by a zipper (60). When the flap (58) is released it provides an access space (56) for repair or replacement of retraction apparatus (24) and wheels (14) or wheels mounting.

4 Claims, 3 Drawing Sheets

10
14
16
20
24
26
28
46
48
50
52
54
56
58
60
62
64
66

LUGGAGE CASE CONSTRUCTION

BACKGROUND

1. Background of the Invention

The present invention relates generally to a luggage case construction, and, more particularly, to such a luggage case construction which provides ready access to hidden from view reinforcement and handle securement apparatus for purposes of repair or replacement and wheel mounting means as may be needed.

2. Description of Related Art

A commonly encountered luggage case at the present time is adapted for wheeled transport, the motive power being provided by an individual pulling (pushing) on an attached handle. In such a luggage case wheels (or rollers) are located on a lower edge with two such wheels being typically provided, one adjacent a first case side and the other adjacent an opposite side of the case, with the case in transport being tipped toward the user while being pushed or pulled. In the pulling use situation, the entire contents of the luggage provides a substantially continuous gravity load on the downwardly directed major surface of the luggage case and for this reason the case includes support struts or members adjacent this lower wall for reinforcement. Also, such luggage when stored during air flight or transported to and from the plane, for example, is for the most part stacked with the same lower wall being in the lowermost position.

Also, pullable wheeled luggage cases frequently include a pulling/pushing handle which is retractable within the case when not being actively used. The apparatus for receiving the handle is unitarily mounted on or adjacent to the reinforced case lower wall and covered by a fabric panel. Moreover, means for mounting the wheels also have parts extending within the luggage and are covered over by a fabric panel.

It is common knowledge that from normal pulling/pushing/carrying use by a luggage case owner and especially as a result of mass handling of luggage that it is subjected to a considerable amount of vibration and shock which can damage not only the exterior appearance of the case, but actually deform or break the wheel mounting opposite as well as the retractability apparatus for the handle. Although some luggage damage may be tolerated, if the handle retraction apparatus or the wheels are impaired this can result in the luggage case being totally immovable by hand pulling because the handle cannot be extended sufficiently for adequate gripping or, of course, the wheels do not turn. Also, if the handle cannot be retracted, this will prevent convenient case storage.

Accordingly, it is a desideratum to make the wheel structural parts and handle retraction apparatus of the luggage case readily available for repair or replacement, and at the same time, not require the replacement of otherwise undamaged textile or fabric panel coverings, both on the inside of the case as well as the outside of the case. It is also a desideratum that fabric coverings providing the aesthetic properties of appearance for the luggage can be readily moved aside while effecting repairs and replacement of underlying apparatus and are able to assume the original covering relationship without requiring additional labor or expense at the conclusion of the repair activity for underlying apparatus.

SUMMARY OF THE INVENTION

In accordance with the practice of the present invention there is provided means incorporated into the luggage construction enabling nondestructive removal of fabric or other material from covering relation to the internal wall-mounted apparatus of the case to obtain direct access for repair and replacement of the underlying apparatus. The same means enables repositioning of the original fabric or other material in covering relation to the apparatus at the conclusion of any repair or replacement of the apparatus.

BRIEF DESCRIPTION OF THE DRAWING

These and other objects of the present invention will become more readily apparent upon reading the following detailed description and reference to the attached drawings upon which.

DESCRIPTION OF A PREFERRED EMBODIMENT

Figure 1:
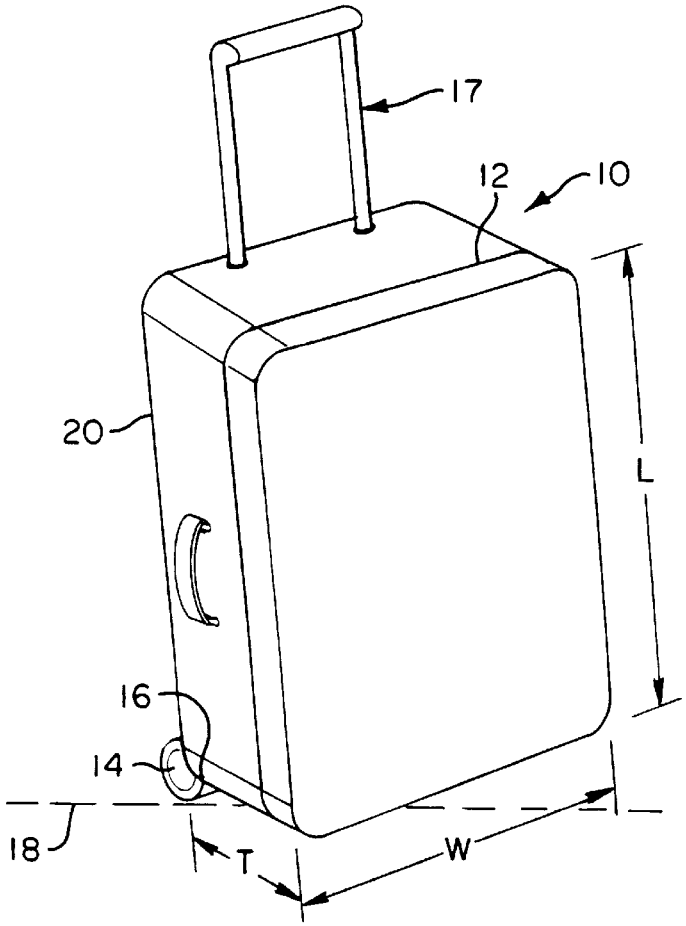
FIG. 1 is a perspective view of a luggage case with which the present invention is most advantageously employed.

Turning now to the drawings and particularly FIG. 1 there is shown a luggage case 10 with which the present invention can be most advantageously employed and in connection with which the invention will be described herein. In particular, the luggage case 10 is a generally parallelepiped arrangement of length L, thickness T, and width W with a releasable access means extending entirely about the case periphery, or more typically three sides thereof, formed by a zipper 12, for example. The luggage case includes a pair of wheels or rollers 14 arranged along a transverse lower edge 16 of the case, and at the opposite case end, a handle means 17 for pulling or pushing the case which are retractable into the case during storage, for example. In pushing/pulling transport of the case, it is typically tilted with respect to the ground plane 18 with a common major surface 20 of the case facing downwardly toward the ground plane. The surface 20, since it will be in a lower position when it is pulled during transport, will be referred herein as the lower or bottom surface and it will be that part of the luggage which will be primarily exposed to pressure of the contained goods in the case during transport.

In the luggage case construction one or more rodlike members 24 are located adjacent the lower wall 20 and extend from an upper edge wall 26 towards the wheel end of the case 28 and connected to the same. The apparatus 24 can have a variety of specific constructions, but essentially is rigid and extends completely from the handle into the case to the wheeled end and includes one or more cavities (not shown) for receiving the handle in retracted position, when desired. The luggage case 10 by virtue of the construction just described is relatively expensive and for that reason also includes exterior wall surfaces constructed of leather or a textile fabric of good appearance and high aesthetics. In view of the latter, penetrating the case outer surface for repair/replacement of internally located apparatus is not desirable because of the associated cost.

In use by the individual owner during transporting luggage to and from an airport or train station, during handling by airport or railroad employees, or when stored in the trunk of a vehicle or elsewhere, such luggage is subjected to a considerable variety of vibration, strain, and shocks which can damage the structural integrity of the luggage case as well as the apparatus for receiving the handle in retracted position and the wheels or wheel mounting structure. Also, even more important, the handling of luggage at airports when they are being transported to and from the planes and along continuous conveyor belts to luggage pickup stations, frequently results in damage to the luggage.

In luggage of this generally described character, the apparatus for enabling retraction of the handle into the case is especially vulnerable to damage from rough handling. Although the repairs can be readily achieved by either replacement of parts or by application of force for straightening bent parts to enable sliding contact of the handle apparatus therein, this necessitates access to the damaged parts by a repairman and repair tools. Specifically, it is necessary to have direct access for hands-on manipulation and replacement or repair of this apparatus and this direct access is impeded by the presence of textile, fabric or other material panels covering the outer portions of the case and, in addition, internally located panel materials are in covering relation to the apparatus and reinforcing structure of the case. It is, therefore, a necessary and primary object of the present invention to provide access to such damaged apparatus in a way that will be described which neither damages nor requires expensive modification or replacement of covering textiles or other paneling.

Figure 2:
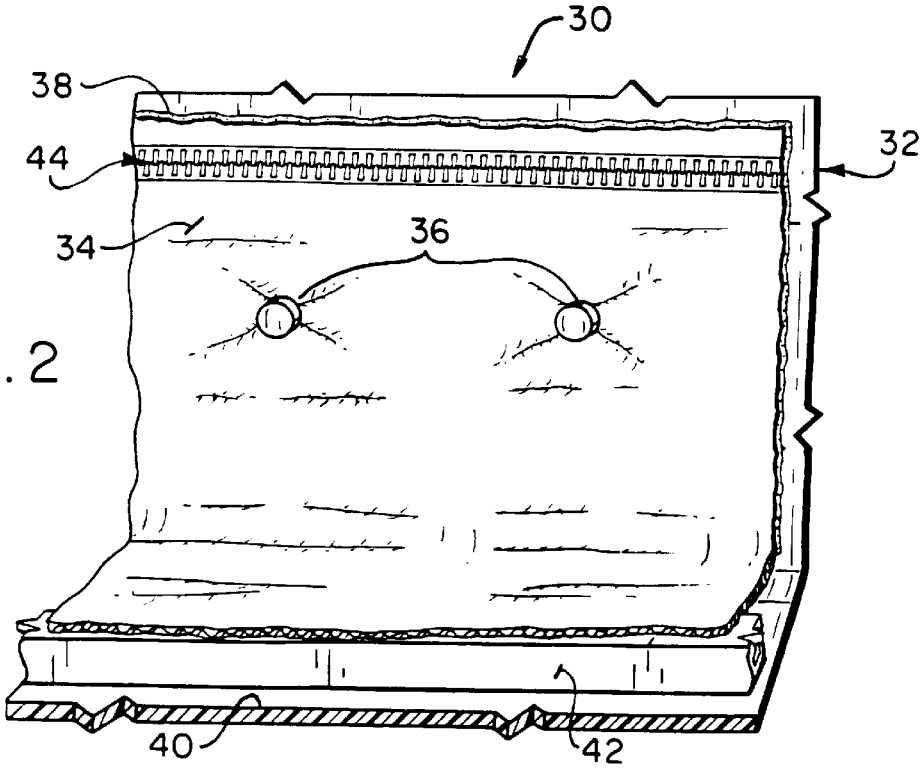
FIG. 2 is a fragmentary elevational view of a luggage case interior of the prior art.
Figure 3:
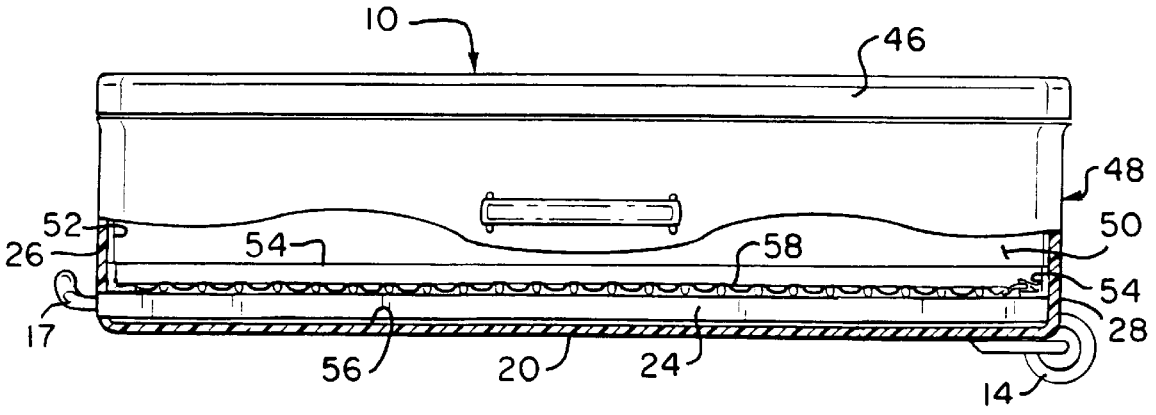
FIG. 3 is a side elevational, sectional view of a luggage case including the present invention shown in covering relation to outer case wall members and handle retraction apparatus.
Figure 4:
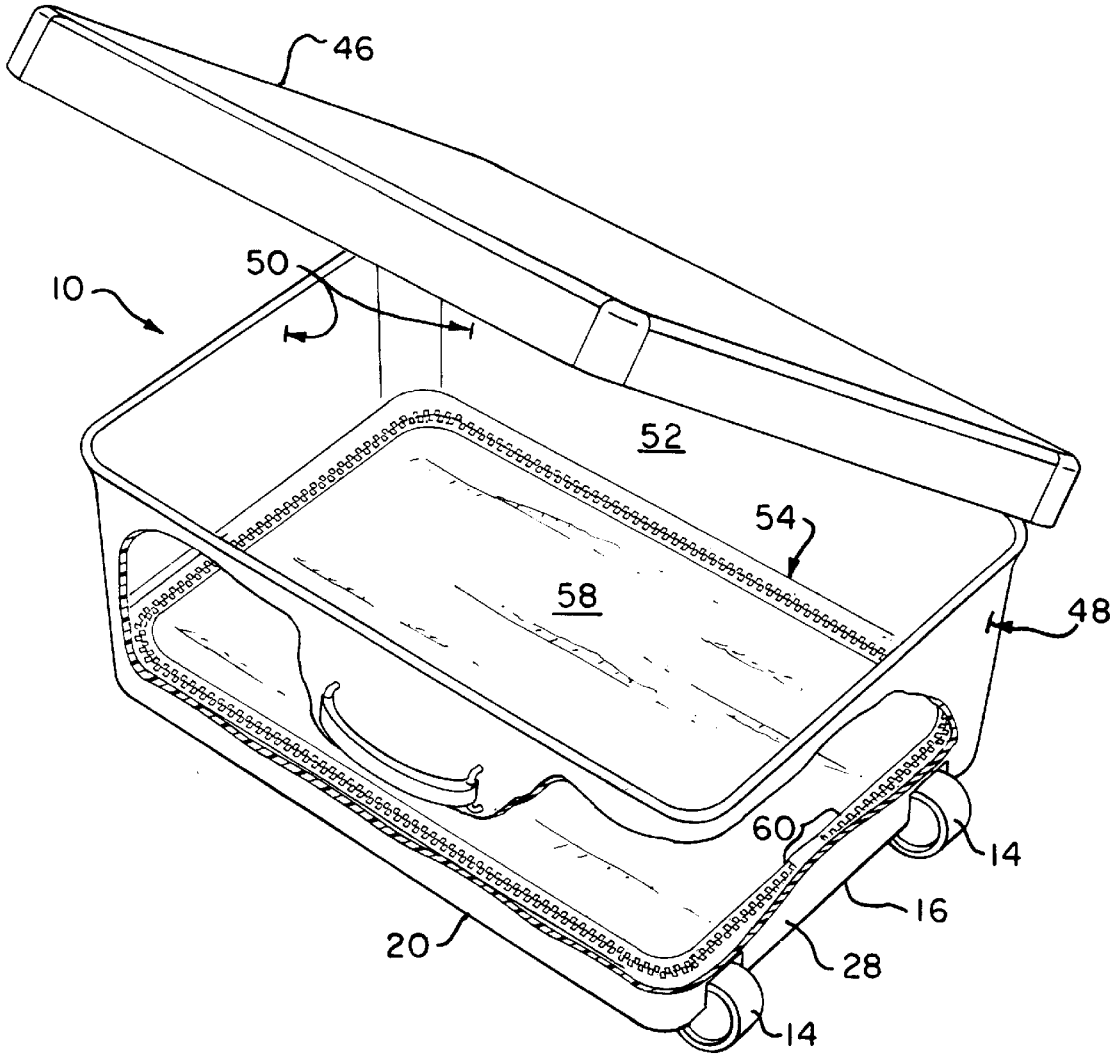
FIG. 4 is a perspective view of the luggage case of FIG. 3 shown with the invention in covering relation to underlying apparatus.

Turning now to FIG. 2, there is shown in partially sectional, fragmentary view, a luggage case 30 of the prior art viewed from the case interior. More particularly, a tupically rigid outer side wall member 32 has its inwardly facing surface covered by a fabric or other material panel 34, which panel is affixed to the side wall member by several spaced apart rivet connectors 36 (two are shown), and, frequently, the panel 34 may be additionally secured to the side wall member 32 by an adhesive material 38. The panel 34 extends down the side wall and over the bottom case panel 40 in covering relation to handle retraction or other apparatus 42 (depicted schematically). During manufacture of one version of prior art case, the fabric panel 34 is a continuous sheet with an uppermost edge secured to other materials affixed to the case side wall by a zipper 44. To repair the apparatus 42, the zipper 44 is moved to the open position and the panel 34 is carefully worked with the hands and fingers (and tools) away from the side wall which, in effect, breaks the adhesive loose. Only a limited amount of space is now available for insertion of the hands and tools between the panel 34 and the side wall 32 due to the obstruction posed by the rivet or screw connectors 36. For such repair, it may be necessary to remove screws and rivets and then on completion of repair/replacement the rivets and screws must also be replaced. Still further, if apparatus replacement is necessary, this almost certainly requires replacement of the panel 34 as well and the zipper 44.

It might be asked why not merely replace the panel 34 each time a repair to underlying apparatus is made. This, of course, would require these panels to be stocked in many different fabrics, patterns, and sizes to accommodate all of the different luggage cases on the market. Without doubt, having to replace a panel 34 when the underlying apparatus is repaired substantially increases overall repair cost.

For the ensuing description of the present invention, reference is made simultaneously to FIGS. 1 and 3–5. The luggage case 10 includes a lid part or upper case portion 46 which is pivotally interconnected with a lower case portion 48 to define the containing space of the case. A continuous sidewall 50 interconnects the lid panel and major lower case panel or bottom 20.

On the interior wall surface of the sidewall 50 there is provided a continuous bandlike fabric or other material panel 52 which is dimensioned and of such geometry as to closely conform to the sidewall 50 and extend from the lid interconnection to a lower point just above the underlying handle retraction apparatus 24. More particularly, the lower edge of panel 52 extends inwardly a slight amount forming a ribbon or strips 54 of fabric extending over and spaced from the case bottom wall 20. The strip 54 defines an enclosed access space 56 which is only slightly less in areal extent than the bottom wall 20. It is this space 56 via which a repairman can repair or replace the apparatus 24 or the wheels 14, as needed.

Figures 5, 6A, 6B, 6C:
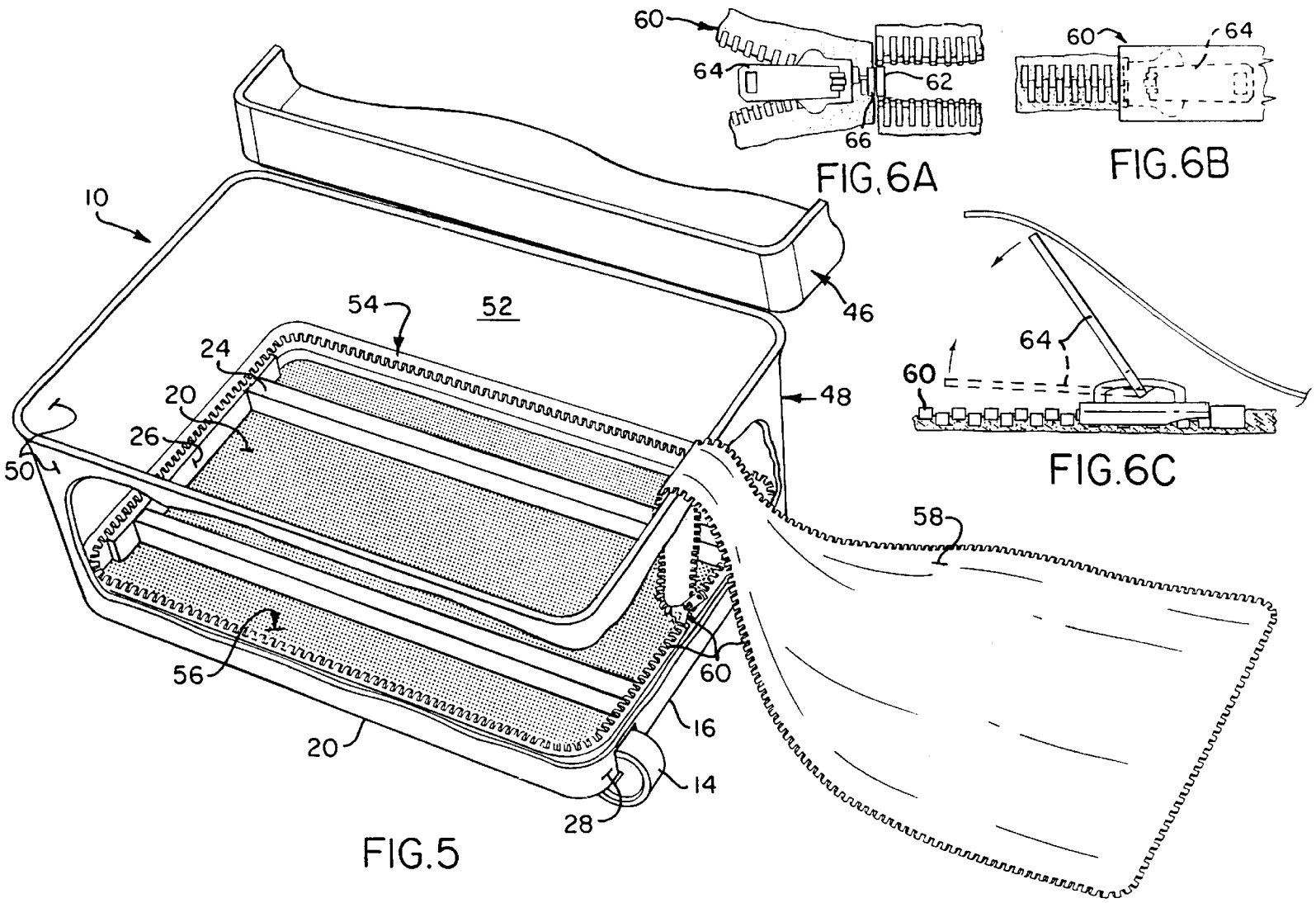
FIG. 5 is a view similar to FIG. 4 with the invention exposing the underlying apparatus to ready view and access.
FIGS. 6A and 6B are enlarged detail views of a zipper tab for the invention in fully open and fully closed modes, respectively.
FIG. 6C shows how the zipper pull-tab is hidden when the zipper is fully closed.

A flap 58 of fabric has a geometry and relative dimensions as to enable fitting receipt over space 56 with the flap edges substantially coincident with the inner edges of ribbon 54. Zipper means 60 releasably interrelates the flap and ribbon edges as shown in FIGS. 6A and 6B. More particularly, a first end 62 of the paired zipper tracks form a fixed connection or "stop". When the zipper is fully closed, the opposite end of the paired zipper tracks extend past and in covering relation to the stop 62 with the zipper pull-tab 64 being capable of being secreted out of view between the second zipper end 66 and first end or stop 62.

On repair of the luggage case, first the flap 58 is unzipped and draped outwardly over the lower or wheeled end 28 of the case (FIG. 5). Necessary repairs or replacements are made and the flap is zipped into closed position (FIG. 4) after which the luggage case is ready for normal use.

Although the present invention has been described in connection with a preferred embodiment, it is to be understood that those skilled in the appertaining arts may contemplate modifications within the spirit of the invention and within the scope of the appended claims.

What is claimed is:

1. In a luggage case of generally parallelepiped construction with a lid panel, a bottom panel and a continuous sidewall interconnecting the lid and bottom panels, wheel means mounted adjacent the interconnection of the bottom and sidewall panels at one end of the case and having mounting means extending within the case, a retractable handle at an opposite end of the case, and apparatus fixedly mounted within the luggage case adjacent the bottom panel for retractably receiving part of the handle, the improvement comprising:

a sheetlike fabric panel having a first major surface arranged in conforming relation to the inner surface of the sidewall and in covering relation to the bottom panel and contacting the handle receiving apparatus and wheel mounting means, and a second major surface facing toward luggage case carrying space said fabric panel including, a first strip portion extending about and affixed to the inner sidewall surface with a continuous edge portion extending partially over and spaced from the bottom panel inner surface, said strip edge portion enclosing a space of area substantially equal to the area of the bottom panel inner surface;

a flap of area and geometry such as to be conformingly received within the space enclosed by said edge portion; and means for releasably securing said flap to said edge portion such that during such securement the panel first major surface is spaced from the bottom panel an amount merely sufficient to accommodate the apparatus for selectable receiving part of the handle.

2. A luggage case as in claim 1, in which the releasable securing means includes a zipper.

3. A luggage case as in claim 1, in which the space enclosed by said edge portions is located directly opposite the handle retracting apparatus and provides ready access to said apparatus for repair and replacement thereof without damaging the fabric panel and flap.

4. A luggage case as in claim 1, in which the releasable securing means include a pull-tab zipper, two joinable tracks of which have first and second end portions, the first end portion forming a fixed stop and the second end portion overlaps the stop with sufficient space therebetween to enable the pull tab to be positioned in the intervening space.

* * * * *